US005136214A

United States Patent [19]

Roberts et al.

[11] Patent Number: 5,136,214

[45] Date of Patent: Aug. 4, 1992

[54] USE OF SILICON TO EXTEND USEFUL LIFE OF METAL HALIDE DISCHARGE LAMPS

[75] Inventors: Victor D. Roberts, Burnt Hills; Douglas A. Doughty, Amsterdam; Jennifer L. Myers, Clifton Park, all of N.Y.

[73] Assignee: General Electric Company, Schenectady, N.Y.

[21] Appl. No.: 553,303

[22] Filed: Jul. 16, 1990

[51] Int. Cl.[5] ..... H05B 41/16

[52] U.S. Cl. ..... 315/248; 315/344; 313/635

[58] Field of Search ..... 315/248, 39, 111.21, 315/344; 313/635, 553, 636

[56] References Cited

U.S. PATENT DOCUMENTS 2,886,730 5/1959 Sheldon ..... 313/553
3,624,444 11/1971 Berthold ..... 313/635
4,360,756 11/1982 Spencer ..... 313/553
4,810,938 3/1989 Johnson et al. ..... 315/248
4,916,359 4/1990 Jönsson ..... 313/635

OTHER PUBLICATIONS

Waymouth, J. F., "Electric Discharge Lamps", MIT Press, 1971, pp. 266–277.

*Primary Examiner*—Eugene R. Laroche
*Assistant Examiner*—Amir Zarabian
*Attorney, Agent, or Firm*—Jill M. Breedlove; James C. Davis, Jr.; Marvin Snyder

[57] ABSTRACT

A silicon flake comprising silicon in a sufficient quantity is inserted into the arc tube of a high-intensity, metal halide discharge lamp in order to avoid a substantial buildup of free halogen, thereby extending the useful life of the lamp.

4 Claims, 1 Drawing Sheet

USE OF SILICON TO EXTEND USEFUL LIFE OF METAL HALIDE DISCHARGE LAMPS

RELATED APPLICATIONS

This application is related to commonly assigned U.S. patent application of H. S. Spacil and R. H. Wilson, Ser. No. 553,038, and to commonly assigned U.S. patent application of H. L. Witting, S. Prochazka, T. B. Gorczyca and J. L. Myers, Ser. No. 558,304, both applications filed concurrently herewith and incorporated by reference herein.

FIELD OF THE INVENTION

The present invention relates generally to high-intensity, metal halide discharge lamps. More particularly, the present invention relates to the use of silicon for extending the useful life of a high-intensity, metal halide discharge lamp.

BACKGROUND OF THE INVENTION

In operation of a high-intensity metal halide discharge lamp, visible radiation is emitted by the metallic component of the metal halide fill at relatively high pressure upon excitation typically caused by passage of current therethrough. One class of high-intensity, metal halide lamps comprises electrodeless lamps which generate an arc discharge by establishing a solenoidal electric field in the high-pressure gaseous lamp fill comprising the combination of a metal halide and an inert buffer gas. In particular, the lamp fill, or discharge plasma, is excited by radio frequency (RF) current in an excitation coil surrounding an arc tube which contains the fill. The arc tube and excitation coil assembly acts essentially as a transformer which couples RF energy to the plasma. That is, the excitation coil acts as a primary coil, and the plasma functions as a single-turn secondary. RF current in the excitation coil produces a time-varying magnetic field, in turn creating an electric field in the plasma which closes completely upon itself, i.e., a solenoidal electric field. Current flows as a result of this electric field, thus producing a toroidal arc discharge in the arc tube.

High-intensity, metal halide discharge lamps, such as the aforementioned electrodeless lamps, generally provide good color rendition and high efficacy in accordance with the principles of general purpose illumination. However, the lifetime of such lamps can be limited by the loss of the metallic component of the metal halide fill during lamp operation and the corresponding buildup of free halogen. In particular, the loss of the metal atoms shortens the useful life of the lamp by reducing the visible light output. Moreover, the loss of the metal atoms leads to the release of free halogen into the arc tube, which may cause arc instability and eventual arc extinction, especially in electrodeless high-intensity, metal halide discharge lamps.

The loss of the metallic component of the metal halide fill may be attributable to the electric field of the arc discharge which moves metal ions to the arc tube wall. For example, as explained in *Electric Discharge Lamps* by John F. Waymouth, M.I.T. Press, 1971, pp. 266–277, in a high-intensity discharge lamp containing a sodium iodide fill, sodium iodide is dissociated by the arc discharge into positive sodium ions and negative iodine ions. The positive sodium ions are driven towards the arc tube wall by the electric field of the arc discharge. Sodium ions which do not recombine with iodine ions before reaching the wall may react chemically at the wall, or they may pass through the wall and then react outside the arc tube. (Normally, there is an outer light-transmissive envelope disposed about the arc tube.) These sodium ions may react to form sodium silicate or sodium oxide by reacting with a silica arc tube or with oxygen impurities. As more and more sodium atoms are lost, there is a buildup of free iodine within the arc tube that may lead to arc instability and eventual arc extinction. Therefore, it is desirable to prevent the buildup of free halogen, thereby extending the useful life of the lamp.

OBJECTS OF THE INVENTION

Accordingly, an object of the present invention is to provide means for preventing a substantial buildup of free halogen, thereby extending the useful life of the lamp.

Another object of the present invention is to provide a method for using silicon in a high-intensity, metal halide discharge lamp in order to prevent a substantial buildup of free halogen, thereby extending the useful life of the lamp.

SUMMARY OF THE INVENTION

The foregoing and other objects of the present invention are achieved in a new and improved method for employing silicon in the arc tube of a high intensity, metal halide discharge lamp in order to extend the useful life thereof. In particular, a solid piece of silicon, e.g. a flake, comprising silicon in a sufficient quantity is inserted into the arc tube during lamp manufacture in order to prevent a substantial buildup of free halogen, thereby extending the useful life of the lamp.

BRIEF DESCRIPTION OF THE DRAWING

The features and advantages of the present invention will become apparent from the following detailed description of the invention when read with the sole accompanying drawing FIGURE which illustrates a high-intensity, metal halide discharge lamp employing silicon in accordance with the present invention.

DETAILED DESCRIPTION OF THE INVENTION

Figure 1:
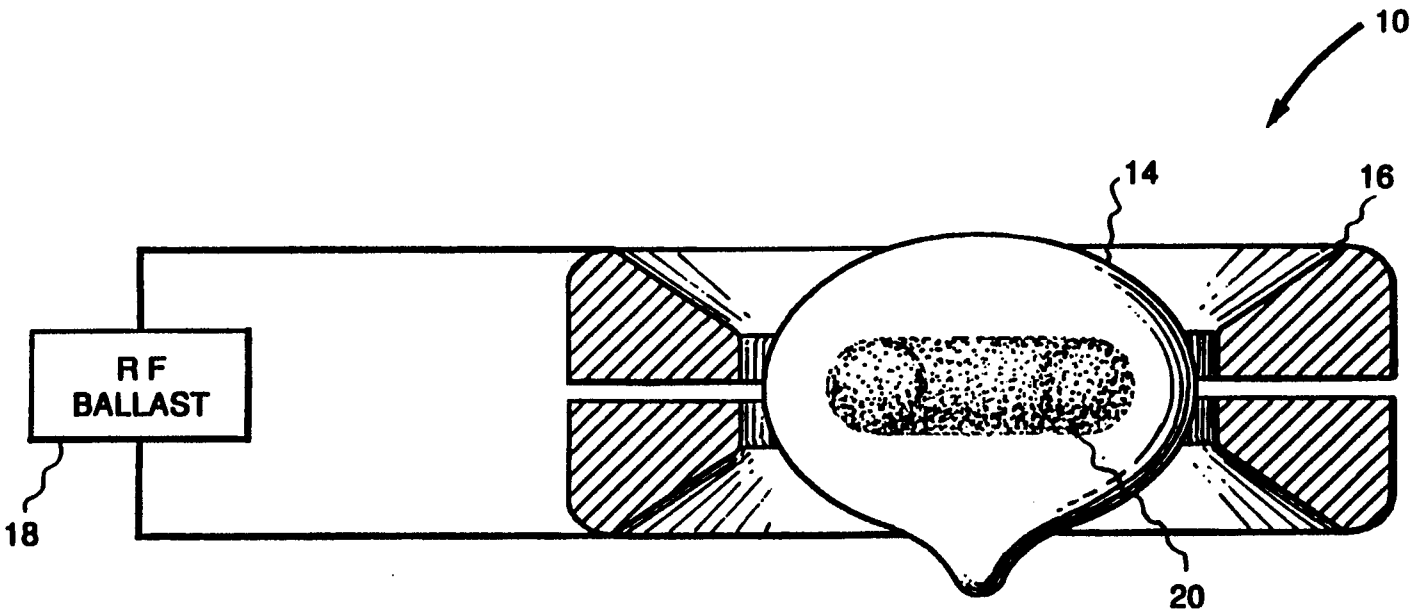

The sole drawing FIGURE illustrates a high-intensity, metal halide discharge lamp 10 employing a silicon flake in accordance with the present invention. For purposes of illustration, lamp 10 is shown as an electrodeless, high-intensity, metal halide discharge lamp. However, it is to be understood that the principles of the present invention apply equally well to high-intensity, metal halide discharge lamps having electrodes. As shown, electrodeless metal halide discharge lamp 10 includes an arc tube 14 formed of a high temperature glass, such as fused silica, or an optically transparent ceramic, such as polycrystalline alumina. By way of example, arc tube 14 is shown as having a substantially ellipsoid shape. However, arc tubes of other shapes may be desirable, depending upon the application. For example, arc tube 14 may be spherical or may have the shape of a short cylinder, or "pillbox", having rounded edges, if desired.

Arc tube 14 contains a metal halide fill in which a solenoidal arc discharge is excited during lamp operation. A suitable fill, described in commonly assigned U.S. Pat. No. 4,810,938 of P. D. Johnson, J. T. Dakin and J. M. Anderson, issued on Mar. 7, 1989, comprises a sodium halide, a cerium halide and xenon combined in weight proportions to generate visible radiation exhibiting high efficacy and good color rendering capability at white color temperatures. For example, such a fill according to the Johnson et al. patent may comprise sodium iodide and cerium chloride, in equal weight proportions, in combination with xenon at a partial pressure of about 500 torr. The Johnson et al. patent is hereby incorporated by reference. Another suitable fill is described in U.S. Pat. No. 4,972,120 of H. L. Witting, issued Nov. 20, 1990 and assigned to the instant assignee, which patent is hereby incorporated by reference. The fill of the Witting Patent comprises a combination of a lanthanum halide, a sodium halide, a cerium halide and xenon or krypton as a buffer gas. For example, a fill according to the Witting Patent may comprise a combination of lanthanum iodide, sodium iodide, cerium iodide, and 250 torr partial pressure of xenon.

Electrical power is applied to the HID lamp by excitation coil 16 disposed about arc tube 14 which is driven by an RF signal via a ballast 18. A suitable excitation coil 16 may comprise, for example, a two-turn coil having a configuration such as that described in commonly assigned, copending U.S. patent application of G. A. Farrall, Ser. No. 493,266, filed Mar. 14,1990, now allowed which patent application is hereby incorporated by reference. Such a coil configuration results in very high efficiency and causes only minimal blockage of light from the lamp. The overall shape of the excitation coil of the Farrall application is generally that of a surface formed by rotating a bilaterally symmetrical trapezoid about a coil center line situated in the same plane as the trapezoid, but which line does not intersect the trapezoid. However, other suitable coil configurations may be used, such as that described in commonly assigned U.S. Pat. No. 4,812,702 of J. M. Anderson, issued Mar. 14, 1989, which patent is hereby incorporated by reference. In particular, the Anderson patent describes a coil having six turns which are arranged to have a substantially V-shaped cross section on each side of a coil center line. Still another suitable excitation coil may be of solenoidal shape, for example.

In operation, RF current in coil 16 results in a time-varying magnetic field which produces within arc tube 14 an electric field that completely closes upon itself. Current flows through the fill within arc tube 14 as a result of this solenoidal electric field, producing a toroidal arc discharge 20 in arc tube 14. The operation of an exemplary electrodeless HID lamp is described in Johnson et al. U.S. Pat. No. 4,810,938, cited hereinabove.

In accordance with the present invention, the silicon flake comprises a sufficient quantity of silicon to prevent a substantial buildup of free halogen. In particular, it is believed that the silicon comprising the flake acts as a halogen getter; that is, the silicon combines with the halogen, thus avoiding a substantial buildup thereof. Advantageously, since a buildup of free halogen typically causes arc instability and eventual arc extinction, preventing such a buildup extends the useful life of the lamp.

In accordance with one preferred embodiment of the present invention, silicon may be advantageously employed in fused silica arc tubes because it is chemically compatible with silica and because it reacts with oxygen impurities to form silica. Moreover, for metal halide lamps having sodium as one of the fill ingredients, silicon is a poor solvent for sodium and does not form compounds therewith.

The following example illustrates how silicon may be advantageously employed in an electrodeless high intensity discharge lamp in accordance with the present invention.

EXAMPLE

Two electrodeless, high-intensity discharge lamps, designated herein as Lamps A and B, each having a fused silica arc tube (20 mm outer diameter and 17 mm height), were operated on a life test using a 250 Watt, RF power supply at 13.56 MHz which delivered current to a two-turn excitation coil surrounding the arc tubes. The arc tubes of Lamps A and B each contained the same fill ingredients. In addition, Lamp A was dosed with a 0.3 mg P-type silicon flake, and Lamp B was dosed with a 0.2 mg N-type silicon flake. After a short burn-in period, it was observed that the silicon flake dissolved into the lamp fill. The lamps were periodically removed from the life test to measure the light output and the level of free iodine. The level of free iodine was monitored in each lamp by measuring the optical absorption at a wavelength of 520 nm. After 449 hours, the measured iodine level in Lamp A was 0.03 mg. After 72 hours, the measured iodine level in Lamp B was 0.00 mg. These levels were compared with those of an arc tube made and operated in the same way, but which did not contain a silicon flake, which arc tube exhibited free iodine levels of 0.15 mg at 370 hours and 0.327 mg at 4059 hours. Moreover, while the arc tube that did not contain a silicon flake exhibited increasing levels of free iodine that led to arc instability and eventual arc extinction, the arc tubes containing a silicon flake did not exhibit increasing levels of free iodine, but maintained substantially the same level throughout the life tests.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

What is claimed is:

1. An electrodeless high intensity discharge lamp, comprising:

a light-transmissive arc tube for containing a plasma arc discharge;

a full contained within said arc tube, said fill including at least one metal halide;

an excitation coil disposed about said arc tube and adapted to be coupled to a radio frequency power supply for exciting said arc discharge in said fill; and a sufficient quantity of silicon contained within said arc tube for preventing a substantial buildup of free halogen in said arc tube, said silicon being at least initially in a solid state.

2. The lamp of claim 1 wherein said silicon is at least initially in a solid state.

3. The lamp of claim 1 wherein said arc tube is comprised of fused silica.

4. A method for manufacturing an electrodeless, high-intensity, metal halide discharge lamp having an arc tube for containing a plasma arc discharge, comprising the steps of:

filling said arc tube with a fill including at least one metal halide;

adding a buffer gas to said fill;

inserting a solid piece of silicon into said arc tube in a sufficient quantity to prevent a substantial buildup of free halogen in said arc tube; and sealing said arc tube.

* * * * *